US007859323B2

(12) United States Patent
Kondo

(10) Patent No.: US 7,859,323 B2
(45) Date of Patent: Dec. 28, 2010

(54) NEGATIVE OUTPUT REGULATOR CIRCUIT AND ELECTRICAL APPARATUS USING SAME

(75) Inventor: Kenya Kondo, Fukuoka (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 12/097,323

(22) PCT Filed: Jan. 5, 2007

(86) PCT No.: PCT/JP2007/050022

§ 371 (c)(1),
(2), (4) Date: Jun. 13, 2008

(87) PCT Pub. No.: WO2007/080828

PCT Pub. Date: Jul. 19, 2007

(65) Prior Publication Data

US 2009/0085649 A1 Apr. 2, 2009

(30) Foreign Application Priority Data

Jan. 10, 2006 (JP) ..... 2006-002712

(51) Int. Cl.
*G05F 1/10* (2006.01)
*G05F 3/02* (2006.01)

(52) U.S. Cl. ..... 327/540; 327/536; 327/537; 363/60

(58) Field of Classification Search ..... 327/148, 327/157, 534–538, 540, 108, 427, 543, 432–437; 363/59, 60

See application file for complete search history.

(56) References Cited

U.S. PATENT DOCUMENTS

| | | | | |
|---|---|---|---|---|
| 6,545,917 | B2 * | 4/2003 | Kim | 365/189.08 |
| 7,649,402 | B1 * | 1/2010 | Chen | 327/536 |
| 2005/0231265 | A1 * | 10/2005 | Yamahira | 327/535 |

FOREIGN PATENT DOCUMENTS

| | | |
|---|---|---|
| JP | 58-2018 | 1/1983 |
| JP | 2-149412 | 12/1990 |
| JP | 07-028536 | 1/1995 |
| JP | 11-327669 | 11/1999 |

* cited by examiner

*Primary Examiner*—Lincoln Donovan
*Assistant Examiner*—Brandon S Cole
(74) *Attorney, Agent, or Firm*—Fish & Richardson P.C.

(57) ABSTRACT

A negative output regulator circuit (24) is provided with clamp circuits CLP (X1, X2, Q1, Q2), which detect a current generated when the output of a negative voltage (VM) is stopped and fixing the voltage of an output end (T2) at a prescribed value. Generation of a positive voltage at an output terminal is suppressed without increasing chip size nor making the sequence complicated.

10 Claims, 8 Drawing Sheets

NEGATIVE OUTPUT REGULATOR CIRCUIT AND ELECTRICAL APPARATUS USING SAME

TECHNICAL FIELD

The present invention relates to a negative output regulator circuit that generates a desired negative voltage based on an input voltage and to an electrical apparatus using such a negative output regulator circuit.

BACKGROUND ART

Conventionally, negative output regulator circuits that generate a desired negative voltage based on an input voltage are widely known, and various technologies have been disclosed and proposed relating to them.

For example, patent document 1 discloses and proposes a technology in which a power transistor is connected in series with a negative power source line. In response to an error signal generated by an error amplifying circuit that depends on the difference between an actual output voltage and a reference voltage. the base current of the power transistor is controlled. Thus it is possible to perform on-off control with a positive potential in a negative output regulator circuit that obtains a desired negative output voltage.

The patent document 1: JP-A-H11-327669

DISCLOSURE OF THE INVENTION

Problems to be Solved by the Invention

It is sure that the above-mentioned conventional negative output regulator circuit is able to generate a desired negative voltage based on an input voltage.

Hereupon, there is a load such as a CCD (Charge Coupled Device) camera module that needs both positive and negative voltages as driving voltages. The positive and negative voltages are usually controlled separately from each other in on-off control.

In a common conventional negative output regulator circuit, in the above-mentioned on-off control, the power transistor is turned off at a time of output halt, and the current path through the power transistor comes to have a high impedance. Consequently, the output terminal of the negative output regulator circuit is shot-circuited via a feedback resistor to a ground terminal, and its potential usually becomes a ground potential (0 V).

However, in the conventional negative output regulator circuit described above, in the case that the output operation only of a negative voltage is halted when a current path is formed between the positive and negative input terminals of the load (in other words, the voltage at the output terminal of the negative output regulator circuit is pulled up to a voltage higher than a ground potential), if a current path whose current flows from the negative side to the output terminal is formed, a current flows into a feedback resistor and a large positive voltage can appear at the output terminal.

Accordingly, in the conventional negative output regulator circuit, the input voltage range set for the negative voltage input terminal of the load cannot be met, and the circuit can be damaged or malfunction.

As a measure to curb a positive voltage, there is a method in which a protective diode is connected between the output terminal and the ground terminal. However, in this method, because the protective diode keeps generating a positive voltage equal to the forward drop voltage thereof (1Vf), it is not always an optimum curbing measure.

There is another method to restrict the positive voltage in which as shown in FIGS. 8A and 8B, discharge transistors Tr1 and Tr2 are connected between the output terminal and the ground terminal. However, in this method, the device sizes need to be made large to lower the on resistances of the transistors Tr1 and Tr2, which makes the chip areas large and is not always an optimum method. Besides, as shown in FIG. 8, if a bipolar transistor is used as the discharge transistor Tr2, there is a disadvantage that the base current increases the current consumption of the circuit.

Further, as still another method to curb the positive output, there is a method in which the order of turning on and off the positive and negative outputs is controlled, for example, in the following manner: first the negative output is turned on; then the positive output is turned on; then the positive output is turned off; and then the negative output is turned off. However, in this method, because the sequence is complicated and the set-side restriction is severe, it is not always an optimum curbing method.

To cope with the problems mentioned above, it is an object of the present invention to provide a negative output regulator circuit which curbs the generation of a positive voltage at the output terminal without making the chip size large or making the sequence complicated, and to provide an electric apparatus using such a negative output regulator circuit.

Means for Solving the Problem

To achieve the object, a negative output regulator circuit according to the present invention generates a desired negative voltage based on an input voltage applied to an input terminal thereof, and supplies the voltage to a load via an output terminal. The negative output regulator circuit is configured to include a clamp circuit that is connected to the output terminal, detects a current that generates at a time of output halt of a negative voltage, and fixes the voltage of the output terminal to a predetermined voltage (the first configuration).

In the negative output regulator circuit having the first configuration, the clamp circuit may be designed to comprise a bias current generating portion that generates a predetermined bias current at a time of output halt of a negative voltage; an flow-in current detecting portion that leads in a flow-in current that flows from a load to an output terminal at a time of output halt of a negative voltage and generates a detecting current corresponding to the flow-in current; a first transistor which is diode-connected, through which the bias current flows at a time of output halt of a negative voltage, and which generates a first voltage lower than the ground potential applied to the ground terminal by a base-emitter drop voltage or a gate-source drop voltage, or a diode which generates the first voltage lower than the ground potential by a forward drop voltage; a second transistor through which a detecting current flows at a time of output halt of a negative voltage and which generates a second voltage higher than the first voltage by a base-emitter drop voltage or a gate-source drop voltage (the second configuration).

In the negative output regulator circuit having the second configuration, the flow-in current detecting portion may be configured to comprise an npn bipolar transistor whose collector is connected to the output terminal, whose emitter is connected to the input terminal, the base is connected not only to the collector or the drain of the second transistor, but also to the input terminal via a resistor (the third configuration)

In the negative output regulator circuit having the third configuration, the npn bipolar transistor is also used as an output power transistor (the fourth configuration)

In the negative output regulator circuit having the second configuration, the flow-in current detecting portion may be configured to comprise a current mirror circuit that generates a mirror current based on the flow-in current, and outputs the mirror current as the detecting current (the fifth configuration).

The negative output regulator circuit which has any one of the first-fifth configurations may be configured to comprise a discharge transistor which is connected in series between the output terminal and the ground terminal and is turned on at a time of output halt of a negative voltage (the sixth configuration).

The negative output regulator circuit which has any one of the first-sixth configurations may be configured to comprise an output power transistor which is connected in series portion the input terminal and the output terminal, an error amplifier which generates an error voltage by amplifying a difference between a feedback voltage depending on the output voltage and a predetermined reference voltage, wherein the operation control of the power transistor according to the error voltage (the seventh configuration).

An electric apparatus according to the present invention comprises any one of the first-seventh negative output regulator circuits (the eighth configuration)

ADVANTAGES OF THE INVENTION

With a negative output regulator circuit according to the present invention, and with an electric apparatus employing it, it is possible to curb the generation of a positive voltage at the output terminal without making the chip size large or making the sequence complicated.

LIST OF REFERENCE SYMBOLS

1 a battery
2 system regulator IC
21 positive voltage step-up circuit
22 negative voltage step-up circuit
23-1 to **23-*n*** first to nth positive output regulator circuits
24 negative output regulator circuit
3 CCD camera module
T1 to T3 external terminals
Qo npn bipolar transistor (power transistor)
Co output capacitor
AMP error amplifier
R1, R2 resistors
Tr1 P channel field effect transistor (discharge transistor)
CLP clamp circuit portion
Q1, Q2 pnp bipolar transistors
X1 bias current generating portion
X2 flow-in current detecting portion
INVa, INVb inverters
Ra to Re resistors
Qa to Qi npn bipolar transistors
Ia constant-current source
Ma N channel field effect transistor

BEST MODE FOR CARRYING OUT THE INVENTION

Hereinafter, a system regulator IC according to the present invention which is incorporated in a mobile phone terminal, converts the output voltage of a battery, and generates driving voltages for different portions (in particular, a CCD camera module) of the terminal will be described as an example.

Figure 1:
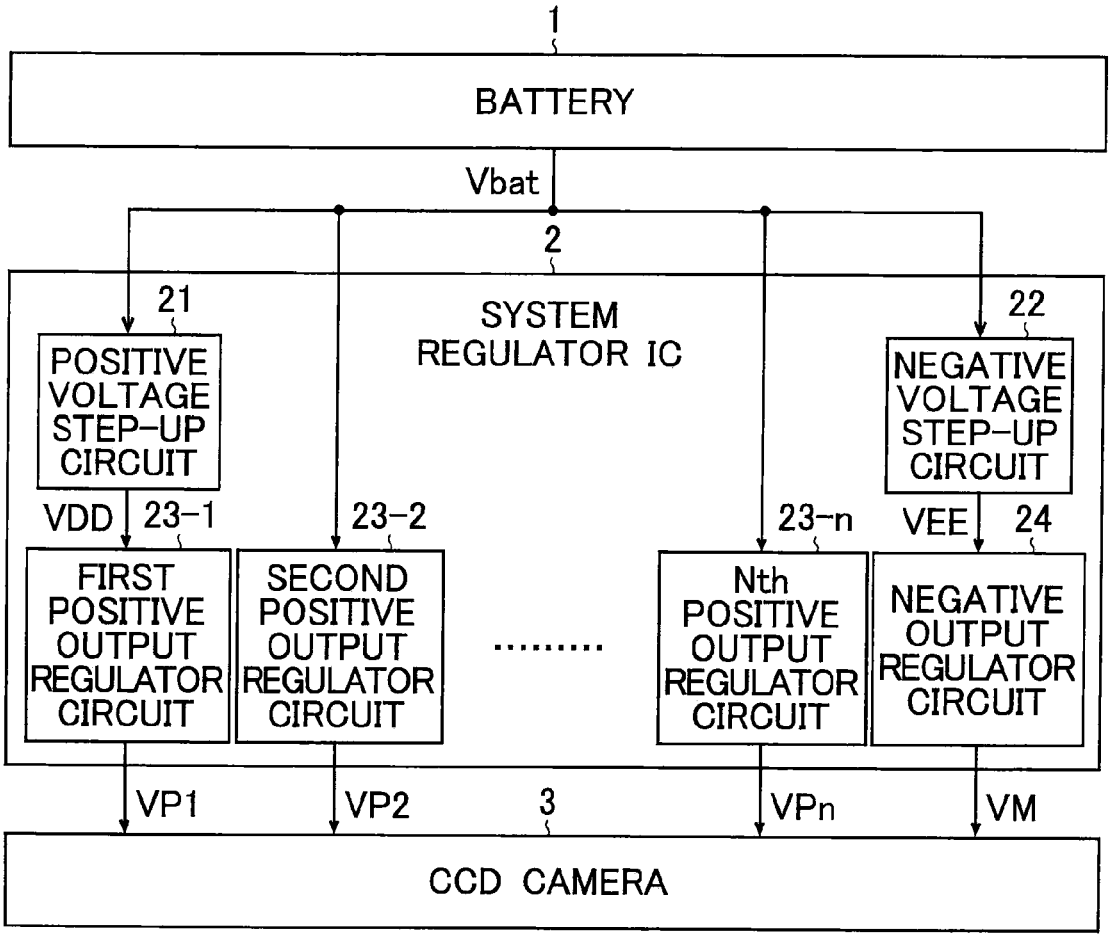
FIG. 1 is a block diagram of a mobile phone according to an embodiment of the present invention.

FIG. 1 is a block diagram of a mobile phone terminal according to an embodiment of the present invention (in particular, a power supply portion for the CCD camera module). As shown in this figure, the mobile phone according to the embodiment comprises a battery 1 as the power source of the apparatus, a system regulator IC 2 as output converting means that converts from the output of the battery 1, and a CCD camera module 3 as image pickup means of the mobile phone. Although not shown in this figure, it is needless to say that the mobile phone according to this embodiment further comprises, as means for performing its essential functions (such as those for communication), a transmitter-receiver unit, a speaker unit, a microphone unit, a display unit, an operation unit, a memory unit and other units, etc.

The CCD camera module 3 needs a plurality of driving voltages (for example, +15 V, +5 V, +3 V, −5 V) to drive its constituent components such as a CCD device, a DSP (Digital Signal Processor), and an I/O (Input/Output) circuit. Accordingly, the system regulator IC 2 comprises a positive voltage step-up circuit 21 which positively steps up the battery voltage Vbat (for example, +3 V) to a predetermined positive stepped-up voltage VDD (for example, +18 V), and a negative voltage step-up circuit 22 which negatively steps up the battery voltage Vbat to a predetermined negative stepped-up voltage VEE (for example, −9 V), and besides, first to nth positive output regulator circuits 23-1 to **23-*n* as means which generate a plurality of positive voltages VP1 to VPn based on the battery voltage Vbat or the positive stepped-up voltage VDD, and a negative output regulator circuit 24 as means which generates a desired negative voltage VM based on the negative stepped-up voltage VEE. The positive voltages VP1 to VPn and the negative voltage VM are all supplied to the CCD camera module 3**.

Figure 2:
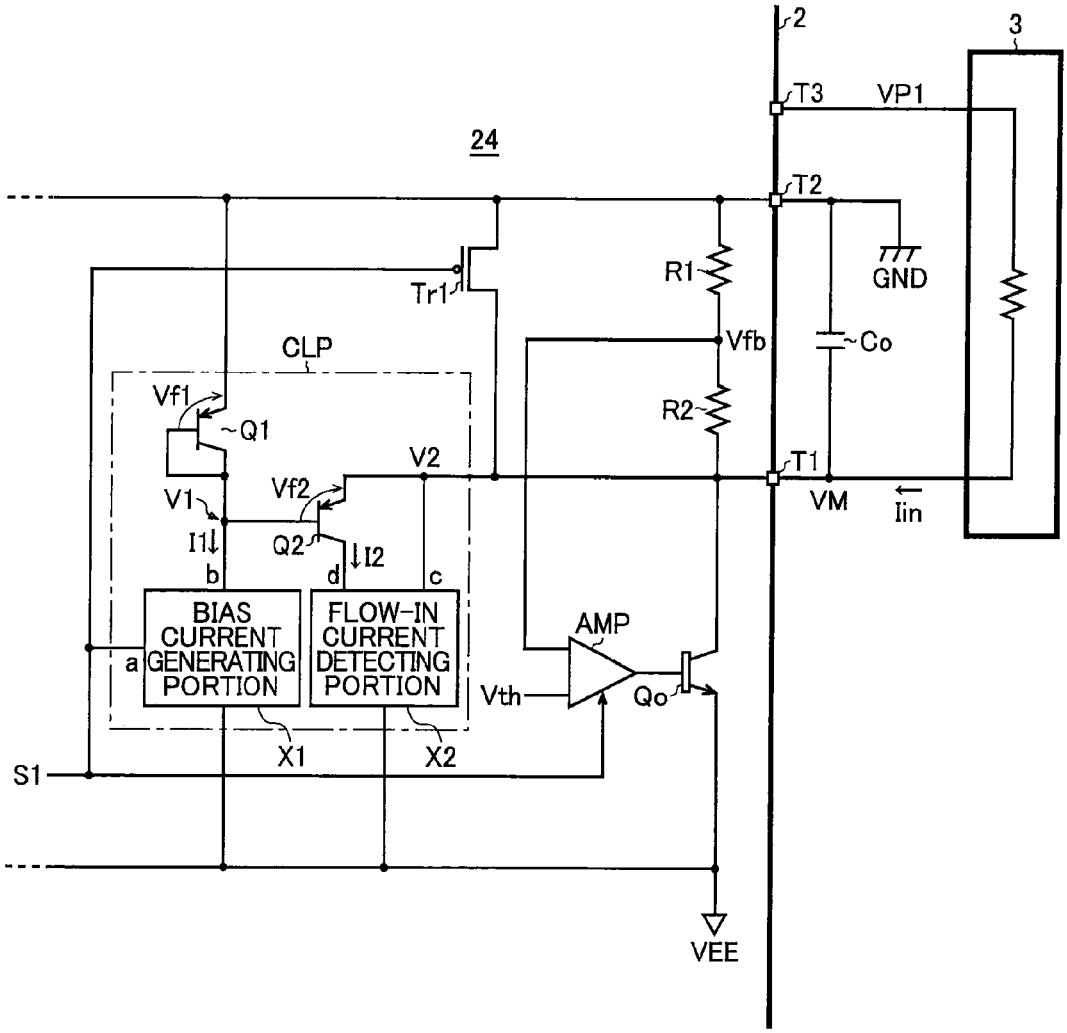
FIG. 2 is a circuit diagram of a negative output regulator circuit 24 according to a first embodiment.

FIG. 2 is a circuit diagram (partly a block diagram) of a negative output regulator circuit 24 according to a first embodiment. As shown in this figure, the negative output regulator circuit 24 according to this embodiment comprises an npn bipolar transistor Qo, an output capacitor Co, resistors R1 and R2, an error amplifier AMP, and a P channel field effect transistor Tr1, and besides, a clamp circuit portion CLP which is a characterizing part of the present invention.

The transistor Qo is an output power transistor that is connected in series between an input terminal to which an input voltage (the negative stepped-up voltage VEE) is applied and an external terminal T1 (an output terminal) from which the negative voltage VM is drawn out.

The output capacitor Co is means which is connected in series between the external terminal T1 and an external terminal T2 (a ground terminal) outside the system regulator IC 2, and which smoothes the negative voltage VM.

The resistors R1 and R2 are connected in series between the external terminal T1 and the external terminal T2 and constitute a resistor division circuit from the connecting node of which a feedback voltage Vfb depending on the negative voltage VM is drawn out.

The error amplifier AMP is means which generates an error voltage by amplifying the difference between the feedback voltage Vfb and a predetermined reference voltage Vth, and supplies the error voltage as a base voltage of the transistor Qo.

Thus the negative output regulator circuit 24 of this embodiment is so constituted that it generates the desired negative voltage VM based on the input voltage VEE by controlling the operation of the transistor Qo according to the error voltage, and supplies the voltage VM to the CCD module 3 via the external terminal T1.

As described above, besides the negative voltage VM, various positive voltages VP1 to Vpn are applied to the CCD module 3 from the system regulator IC 2. A current path that passes through the CCD module 3 is constituted between the external terminals (only an external terminal T3 for outputting the positive voltage VP1 is shown in this figure) via which these positive voltages VP1 to VPn are outputted and the external terminal T1.

Figure 3:
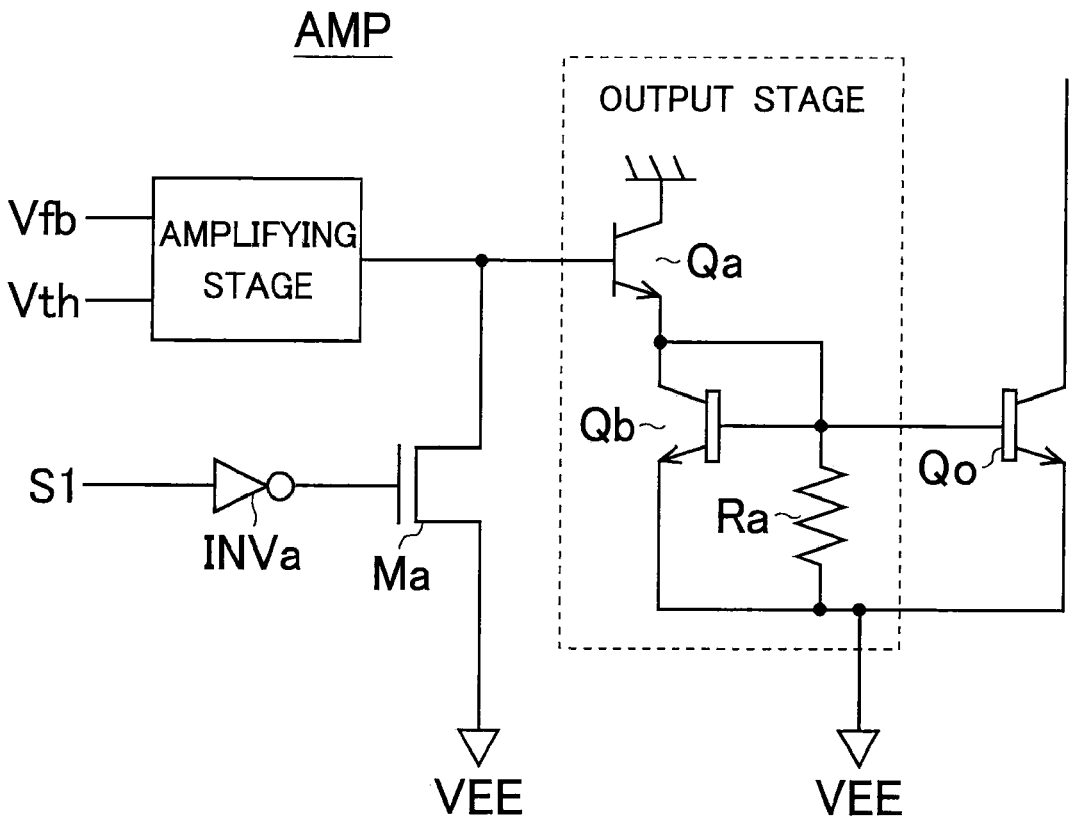
FIG. 3 is a circuit diagram of an output stage of an error amplifier AMP.

On the other hand, the error amplifier AMP is controlled to be turned on or off based on a control signal S1 from a logic unit (not shown) of the system regulator IC 2. Specifically, an output stage (driving stage) of the error amplifier AMP is so constituted as shown in FIG. 3 that it is allowed to operate when an N channel field effect transistor Ma is in an off state, and is inhibited from operating when the transistor Ma is in an on state. In this embodiment, when the control signal S1 is logically high, the operation of the error amplifier AMP (hence the output operation of the negative voltage VM) is allowed, and inversely, when the control signal S1 is logically low, the operation of the error amplifier AMP (hence the output operation of the negative voltage VM) is inhibited. The output operations of the positive voltages VP1 to VPn are likewise controlled.

As describe above, in the mobile phone according to this embodiment, both positive and negative voltages are needed as the driving voltages for the CCD module 3 as a load, while each of the positive and negative voltages can be separately controlled to turned on and off.

Therefore, in the case that the output operation only of the negative voltage VM is inhibited with the output operation of the positive voltages VP1 to VPn continued, that is, when the voltage at the external terminal T1 is pulled up to a potential higher than a ground potential GND via the CCD module 3, a flow-in current Iin flows into the resistors R1 and R2 from the CCD module 3 side and a high positive voltage can appear at the external terminal T1.

Accordingly, the negative output regulator circuit 24 according to this embodiment has a transistor Tr1 and a clamp circuit portion CLP as curbing means to suppress the positive voltages.

The transistor Tr1 is a discharge transistor which is connected in series between the external terminal T1 and the external terminal T2 and is turned on by the control signal S1 at a time of output halt of the negative voltage VM. In this embodiment, when the control signal S1 is logically high, the transistor Tr1 is tuned off, and inversely, when the control signal S1 is logically low, the transistor Tr1 is turned on. Because the transistor Tr1 allows the flow-in current Iin to be drawn in to the external terminal T2, it is possible to suppress the generation of the positive voltage.

On the other hand, the clamp circuit portion CLP is means to clamp a voltage level of the external terminal T1 at a predetermined value at a time of output halt of the negative voltage VM, and has pnp bipolar transistors Q1 and Q2, a bias current generating portion X1, and a flow-in current detecting portion X2 as shown in FIG. 2.

The bias current generating portion X1 is means which generates a bias current I1 at a time of output halt of the negative voltage VM according to the control signal S1 applied to a node "a" and outputs it from a node "b".

The flow-in current detecting portion X2 is means which draws in a flow-in current I1 from a node "c" at a time of output halt of the negative voltage VM, generates a detecting current I2 commensurate with it and outputs the detecting current I2 from a node "d".

The transistor Q1 is means through which a bias current I1 flows at a time of output halt of the negative voltage VM and which generates at its collector terminal a first voltage V1 (=−Vf1) that is lower than the ground potential GND by its base-emitter drop voltage Vf1. The emitter of the transistor Q1 is connected to the external terminal T2. The collector of the transistor Q1 is connected to an output terminal (node "b") of the bias current generating unit portion X1. The base of the transistor Q1 is connected to its own collector. Thus the transistor Q1 is diode-connected. If the characteristic matching with the transistor Q2 is not taken into account, a diode may be used instead of the transistor Q1.

The transistor Q2 is means through which a detecting current I2 flows at a time of output halt of the negative voltage VM and which generates at its emitter terminal a second voltage V2 (=Vf2−Vf1), as the clamp voltage for the external terminal T1, that is higher than the first voltage V1 by its base-emitter drop voltage Vf2. The emitter of the transistor Q2 is connected to the external terminal T1. The collector of the transistor Q2 is connected to the output terminal (node "d") of the flow-in current detecting portion X2. The base of the transistor Q2 is connected to the collector of the transistor Q1.

Figure 4:
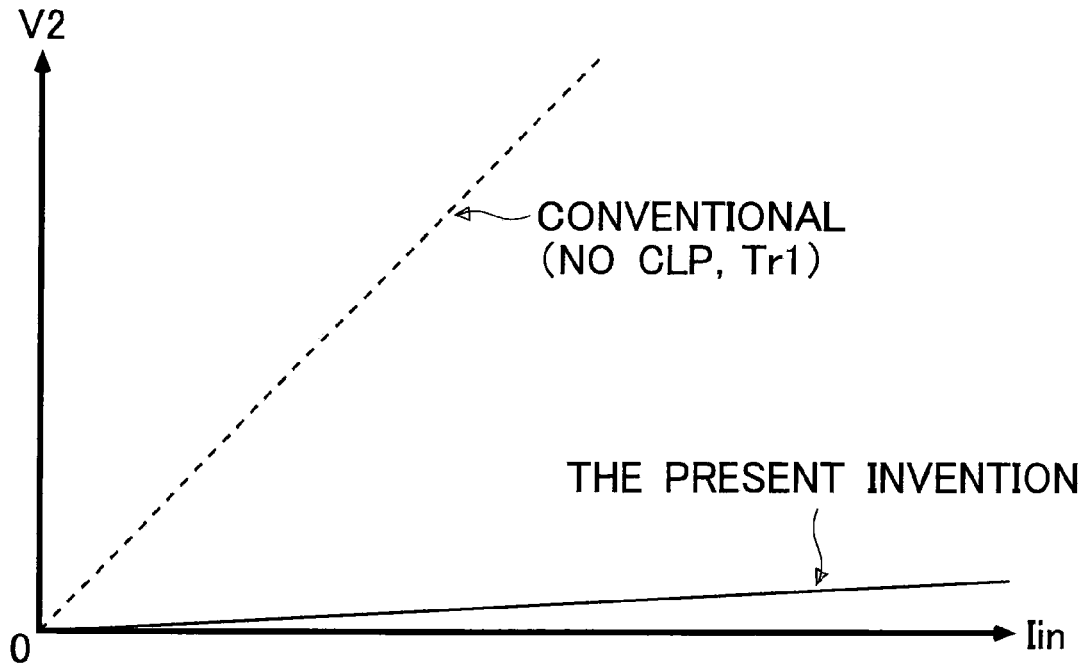
FIG. 4 is a view illustrating an output clamp operation.

In the negative output regulator circuit 24 according to this embodiment, the clamp circuit portion CLP that has the above-mentioned configuration allows the voltage level of the external terminal T1 to be clamped at the second voltage V2 (almost 0 V) at a time of output halt of the negative voltage VM without excessively reducing the on resistance of the transistor Tr1 and without controlling the order of turning on and off the positive and negative outputs (see FIG. 4). Thus, with the negative output regulator circuit 24 according to this embodiment, it is possible to effectively curb the generation of positive voltages at the external terminal T1 without making the chip size large or making the sequence complicated.

The clamp circuit unit CLP having the above configuration functions only at a time of output halt of the negative voltage VM, and has no influence on the output operation of the negative voltage VM.

Next, an example of a configuration of the bias current generating portion X1 will be explained in detail referring to FIGS. 5A and 5B.

Figure 5A:
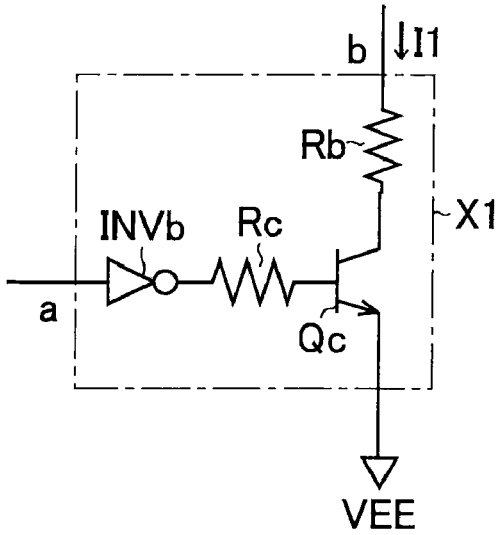
FIG. 5A is a circuit diagram of an example of a bias current generating portion X1.
Figure 5B:
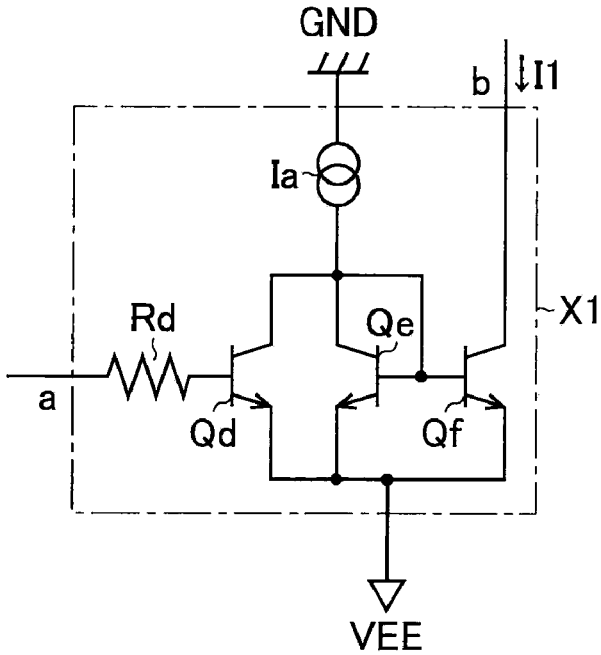
FIG. 5B is a circuit diagram of another example of the bias current generating portion X1.

FIGS. 5A and 5B are each a circuit diagram showing an example of a circuit configuration of the bias current generating portion X1.

The bias current generating portion X1 shown in FIG. 5A comprises an npn bipolar transistor Qc, resistors Rb and Rc, and an inverter INVb. The collector of the transistor Qc is connected to one end of the resistor Rb. The emitter of the transistor Qc is connected to the input terminal to which a negative stepped-up voltage VEE is applied. The base of the transistor Qc is connected to the output terminal of the inverter INVb via the resistor Rc. The input terminal of the inverter INVb corresponds to the node "a", and the other end of the resistor Rb corresponds to the node "b".

In the bias current generation portion X1 having the above configuration, when the control signal S1 applied to the node "a" is logically high (that is, when the output operation of the negative voltage VM is permitted), the transistor Qc is turned off and the output of the bias current I1 is inhibited. On the other hand, the control signal S1 is logically low (that is, when the output operation of the negative voltage VM is inhibited), the transistor Qc is turned on and the output of the bias current I1 is permitted.

With the configuration described above, it is possible to constitute the bias current generating portion X1 with a simple configuration.

The bias current generating portion X1 shown in FIG. 5B comprises npn bipolar transistors Qd to Qf, a constant-current source Ia having no temperature dependence, and a resistor Rd. The collectors of the transistors Qd and Qe are all connected to the ground terminal (the external terminal T2) via the constant-current source Ia. The emitters of the transistors Qd to Qf are all connected to the input terminal to which the negative stepped-up voltage VEE is applied. The base of the transistor Qd is connected to one end of the resistor Rd. The bases of the transistors Qe to Qf are all connected to the collector of the transistor Qe. The other end of the resistor Rd corresponds to the node "a", and the collector of the transistor Qf corresponds to the node "b". Thus the transistors Qe to Qf constitute a current mirror circuit that generates a mirror current depending on a constant current from the constant-current source Ia and outputs it as the bias current I1 via the node "b".

In the bias current generating portion X1 constituted as described above, when the control signal S1 applied to the node "a" is logically high (that is, when the output operation of the negative voltage VM is permitted), because the transistor Qd is turned on, the current mirror circuit is short-circuited and the output of the bias current I1 is inhibited. On the other hand, when the control signal S1 is logically low (that is, when the output of the negative voltage VM is inhibited), because the transistor Qd is turned off, the current mirror circuit is driven and the output of the bias current I1 is permitted.

Unlike the constitution shown in FIG. 5A, in the above constitution, the direct-current amplification factor $h_{FE}$ is not influenced by the ambient temperature and does not fluctuate, and a constant bias current I1 can be generated.

Next, an example of a configuration of the flow-in current detecting portion X2 will be explained in detail referring to FIGS. 6A and 6B.

Figure 6A:
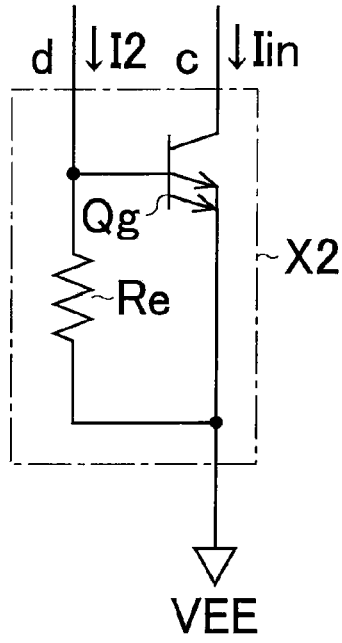
FIG. 6A is a circuit diagram of an example of a flow-in current detecting portion X2.
Figure 6B:
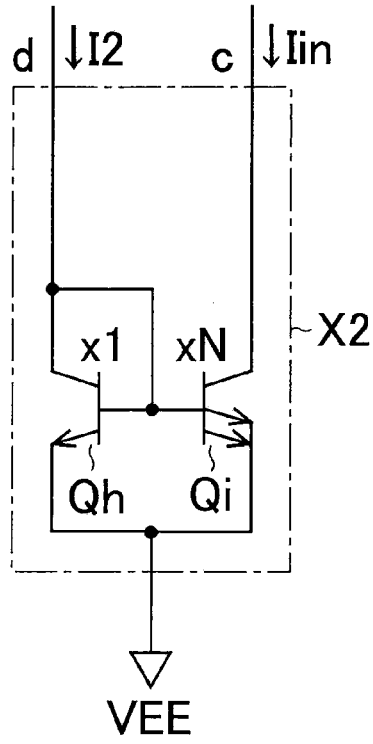
FIG. 6B is a circuit diagram of another example of the flow-in current detecting portion X2.

FIGS. 6A and 6B are each a circuit diagram showing an example of a circuit configuration of the flow-in current detecting portion X2.

The flow-in current detecting portion X2 shown in FIG. 6A comprises a npn bipolar transistor Qg and a resistor Re. The emitters (multiple emitters) of the transistor Qg are connected to the input terminal to which the negative stepped-up voltage VEE is applied. The base of the transistor Qg is connected to the input terminal via the resistor Re. The collector of the transistor Qg corresponds to the node "c", and the base of the transistor Qg corresponds to the node "d".

In the flow-in current detecting portion X2 configured as described above, when the flow-in current Iin is drawn into the node "c", a base current equal to $1/h_{FE}$ ($h_{FE}$ is the direct-current amplification factor) of the flow-in current Iin flows into the base of the transistor Qg, and a current of Vf/Re (Vf is a base-emitter drop voltage of the transistor Qg, and Re is a resistance value of the resistor Re) flows through the resistor Re. Accordingly, the detecting current I2 which is the sum of both these currents is output from the node "d".

With the configuration described above, it is possible to constitute the flow-in current detecting unit portion X2 with a simple configuration.

The flow-in current detecting portion X2 shown in FIG. 6B comprises npn bipolar transistors Qh and Qi. The emitters of the transistors Qh and Qi (the transistor Qi has multiple emitters) are all connected to the input terminal to which the negative stepped-up voltage VEE is applied. The base of the transistors Qh and Qi are all connected to the collector of the transistor Qh. The collector of the transistor Qi corresponds to the node "c", and the collector of the transistor Qh corresponds to the node "d". The pn junction area of the transistor Qi is made N ($\geqq 1$) times as large as that of the transistor Qh. Thus the transistors Qh and Qi constitute a current mirror circuit which generates a mirror current (Iin/N) commensurate with the flow-in current Iin that is drawn into the node "c", and outputs it as the detecting current I2.

Unlike the constitution shown in FIG. 6A, in the above constitution, the direct-current amplification factor $h_{FE}$ is not influenced by the ambient temperature and does not fluctuate, and a detecting current I2 commensurate with the flow-in current Iin can be generated.

In the above embodiment, a system regulator IC according to the present invention which is incorporated in a mobile phone has been explained as an example. However, the application of the present invention is not limited to it, but the present invention can be widely applied to negative voltage regulator circuits in general which generate a desired negative voltage based on an input voltage.

In addition, besides the configuration in the above embodiment, the configuration of the present invention can be modified in various ways within the scope of the present invention.

Figure 7:
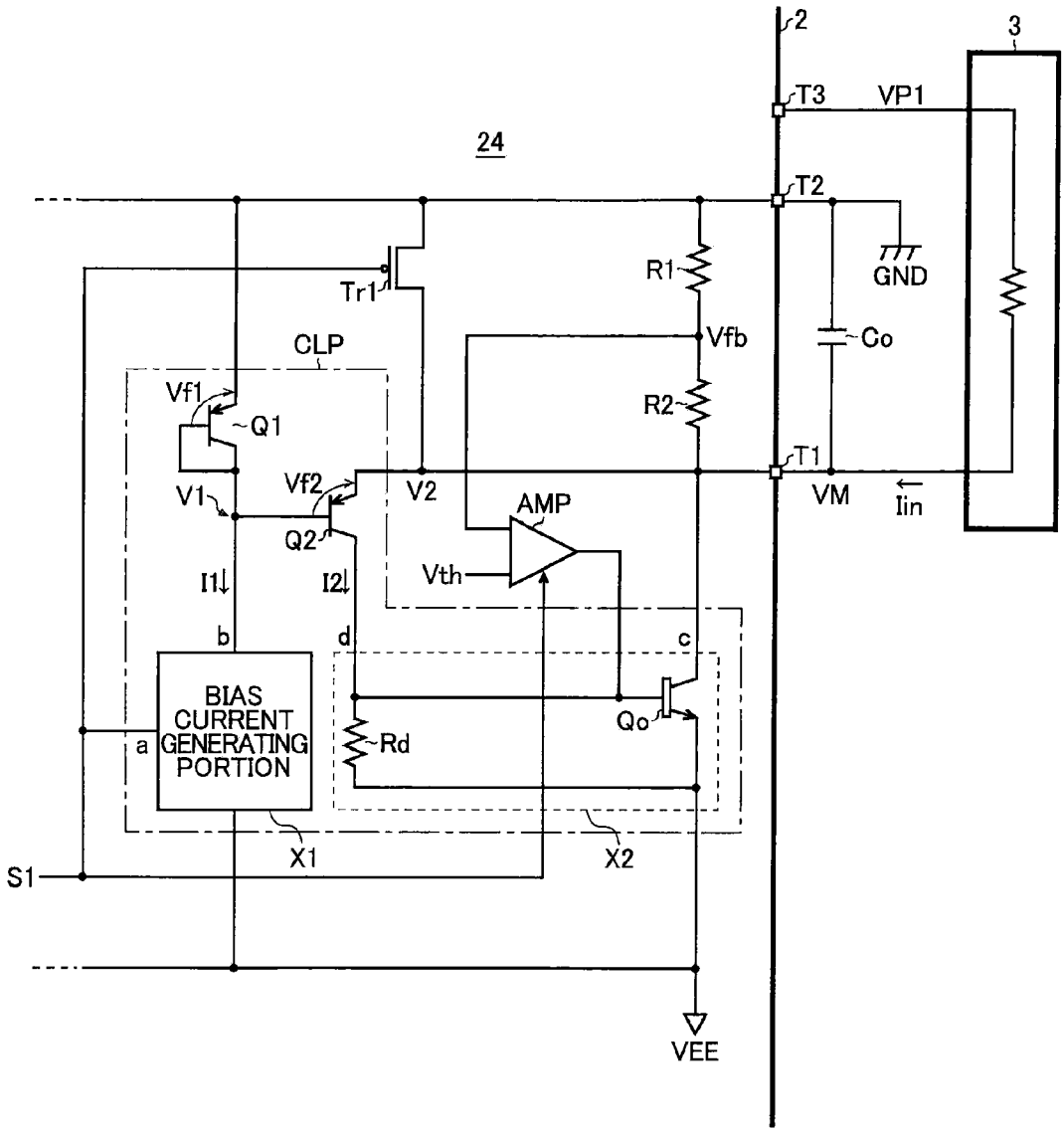
FIG. 7 is a circuit diagram of a negative output regulator circuit 24 according to a second embodiment.
Figure 8A:
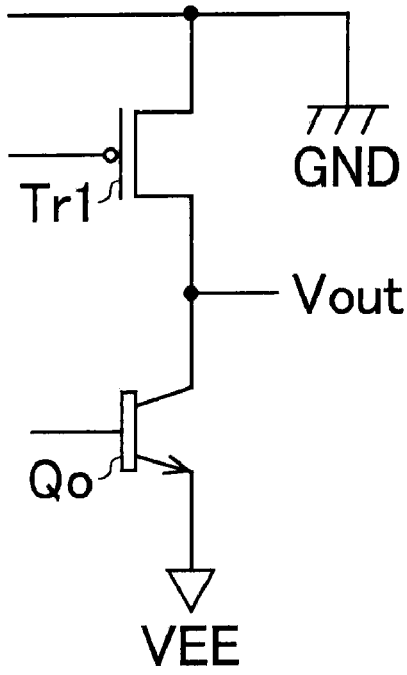
FIG. 8A PRIOR ART
FIG. 8A is a circuit diagram of a conventional negative output regulator circuit.
Figure 8B:
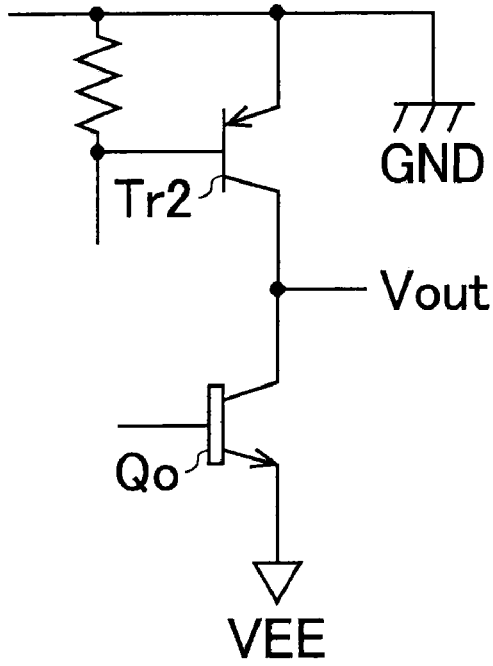
FIG. 8B PRIOR ART
FIG. 8B is a circuit diagram of another conventional negative output regulator circuit.

For example, the above embodiment deals with a configuration in which the clamp circuit CLP is completely separate from the other circuit portions. However, the configuration of the present invention is not limited to this constitution, and as shown in FIG. 7, the output power transistor Qo may be shared as the npn bipolar transistors (which corresponds to the transistors Qg, Qi shown in FIG. 6A and FIG. 6B) provided in the flow-in current detecting portion X2 of the clamp circuit unit CLP. Such a configuration makes it possible to obtain the same effect without making the chip size unnecessarily large. This configuration is possible on the condition that the output stage (driving stage) of the error amplifier AMP shown in FIG. 3 is in an off state according to the control signal S1. Specifically, when the control signal S1 is logically low and the transistor Ma is transited to an on state, a base current for the transistor Qa is drawn out from the amplification stage and the transistors Qa and Qb are turned off. Accordingly, the output transistor Qo also is usually turned off. However, in the configuration of the present invention, because the clamp circuit unit CLP operates, the output transistor Qo also can operate.

Further, in the above embodiment, although the bipolar transistors are used as the transistors Q1, Q2, the configuration of the present invention is not limited to it, and field effect transistors may be used. In such a case, P channel field effect transistors may be used instead of the pnp bipolar transistors, and N channel field effect transistors may be used instead of the npn bipolar transistors. Their different terminals are then so connected that the emitters correspond to the sources, the collectors to the drains, and the bases to the gates.

Likewise, the above embodiment deals with, as an example, a configuration in which the bipolar transistors are used as the devices that constitute the bias current generating portion X1 and the flow-in current detecting portion X2. However, the configuration of the present invention is not limited to it, and field effect transistors may be used. In this case, the resistors Rc and Rd (limiting resistors necessary because of the characteristics of a bipolar transistor) shown in FIGS. 5A, 5B are unnecessary.

INDUSTRIAL APPLICABILITY

The present invention is a useful technology to improve the reliability of a negative output regulator circuit which generates a desired negative voltage based on an input voltage.

The invention claimed is:

1. A negative output regulator circuit that generates a desired negative voltage based on an input voltage, supplies to a load via an output terminal, and is controlled to be turned on or off in response to a control signal, the negative output regulator circuit comprising:

a clamp circuit connected to a reference voltage, connected to the control signal, and arranged to output a predetermined voltage to the output terminal based on the reference voltage when the negative output regulator is turned off in response to the control signal, an output power transistor connected in series between the input voltage and the output terminal, and an error amplifier arranged to amplify a difference between a feedback voltage commensurate with the output voltage and a predetermined reference voltage, and arranged to generate an error voltage, wherein operation of the power transistor is controlled according to the error voltage.

2. A negative output circuit regulator according to claim 1, wherein the clamp circuit comprises:

a bias current generating portion connected to the control signal and arranged to generate a predetermined bias current in response to the input voltage when the negative output regulator is turned off;

a flow-in current detecting portion arranged to draw in a flow-in current from the output terminal when the negative output circuit is turned off and arranged to generate a detecting current commensurate with the flow-in current;

a first transistor connected to the reference voltage and arranged to output a first voltage in response to the bias current; and a second transistor connected to the output terminal, connected to the flow-in current detecting portion and arranged to generate a second voltage as the predetermined voltage to the output terminal in response to the first voltage.

3. A negative output regulator circuit according to claim 2, wherein the flow-in current detecting portion comprises an npn bipolar transistor whose collector is connected to the output terminal, whose emitter is connected to the input voltage, and wherein the npn bipolar transistor is connected to the collector or drain of the second transistor, the flow-in current detecting portion further comprising a resistor connected between a base of the npn bipolar transistor and the input voltage.

4. A negative output regulator circuit according to claim 3, wherein the npn bipolar transistor is also arranged for use as an output power transistor.

5. A negative output regulator circuit according to claim 2, wherein the flow-in current detecting portion comprises a current mirror circuit arranged to generate a mirror current commensurate with the flow-in current and arranged to output the mirror current as the detecting current.

6. The negative output circuit regulator according to claim 2, wherein the second voltage is 0V.

7. The negative output circuit regulator according to claim 2, wherein the first transistor is a diode-connected transistor.

8. A negative output regulator circuit according to claim 1, further comprising a discharge transistor connected in series between the output terminal and a ground terminal and arranged to be turned on when the negative output circuit regulator is turned off.

9. The negative output circuit regulator according to claim 8, wherein the discharge transistor is controlled by the control signal.

10. An electronic apparatus comprising: a negative output regulator circuit according to claim 1.

* * * * *